US006403025B2

(12) United States Patent
Göransson

(10) Patent No.: US 6,403,025 B2
(45) Date of Patent: Jun. 11, 2002

(54) METHOD AND A DEVICE FOR COMPACTING OF POWDER METAL BODIES

(75) Inventor: Bo Göransson, Göteborg (SE)

(73) Assignee: SKF Nova AB, Goteborg (SE)

( * ) Notice: Subject to any disclaimer, the term of this patent is extended or adjusted under 35 U.S.C. 154(b) by 0 days.

(21) Appl. No.: 09/749,814

(22) Filed: Dec. 28, 2000

(51) Int. Cl.[7] ..... B22F 3/02
(52) U.S. Cl. ..... 419/38; 419/66; 425/78
(58) Field of Search ..... 419/66, 38; 425/78

(56) References Cited

U.S. PATENT DOCUMENTS 3,734,658 A 5/1973 Livera

OTHER PUBLICATIONS

U.S. application No. 09/839,150, "Power Pressing Method and Device", Bo Göransson, filed Apr. 23, 2001.
U.S. application No. 09/977,993, "A Method and Apparatus for Compacting a Powder Material Into a Homogenous Article", Peter Nordell et al., filed Oct. 17, 2001.

*Primary Examiner*—Daniel J. Jenkins
(74) *Attorney, Agent, or Firm*—Burns, Doane, Swecker & Mathis, L.L.P.

(57) ABSTRACT

Method and device for production of powder metal bodies comprising: introducing powder material (4) in a compacting chamber (4) in a hollow die (1), compacting the material in mainly axial direction in the compacting chamber by urging a first punch (2), axially into said compacting chamber, advancing said first punch (2) further into compacting chamber for further compacting the powder material and imparting upon the die plate (1) a biasing tension, causing the edge portion of the die opening to move under increasing tension in the same direction as the first punch (2), thereby causing opening radial size reduction, causing axial compression also in a direction opposed to that by the first punch (2) by a second punch (3), arranged to move opposed relative the die (1) as compared to that of the first punch (2), and retracting the first punch (2) axially, thereby relieving the hollow die from its biasing and regaining initial form, thereby simultaneously expelling the compact thus formed.

10 Claims, 2 Drawing Sheets

METHOD AND A DEVICE FOR COMPACTING OF POWDER METAL BODIES

BACKGROUND OF THE INVENTION

The present invention relates to production of powder metal bodies by means of "isostatic" compaction or compression, and in particular symmetrical solids of rotation produced by axial compression of a metal powder aggregate, by means of one or more punches compressing a powder aggregate in a compression chamber provided in a die.

At axial compression of powder aggregates for production of such rotational symmetrical bodies, such as cylinders or the like, it is often a problem that it is difficult to impart upon the entire body a sufficiently high and uniform pressure. There is a tendency that the pressure will be high close to the die but decrease with the distance from the punch. If pressurizing the entire body in a uniform manner is successful, the body is often subjected to stresses, which might often be so big, that the body will be subjected to cracking or scoring when removed from the die. The expelling of the compact furthermore requires very large forces.

SUMMARY OF THE INVENTION

An object of the present invention is to provide a method for isostatic compression of powder metal bodies, whereby the above problems are eliminated. According to one aspect, the present invention provides a method for producing a rotational symmetrical powder metal body comprising:

a) introducing a predetermined volume of powder material into a compacting chamber, provided in a hollow die comprising at least one die plate having a central opening, which has substantially the cross sectional shape of the body to be produced, b) compacting the material in mainly an axial direction in the compacting chamber with a first punch, by urging said first punch axially into said compacting chamber, c) advancing said first punch further into said compacting chamber, thereby further compacting the powder material, d) imparting upon the at least one die plate a biasing tension, causing an edge portion encircling the opening in the at least one die plate to move slightly under increasing tension in the direction of the advance movement of the first punch, thereby causing radial reduction of the size of the opening, e) causing axial compression also in a direction opposed to that caused by the said first punch by means of a second punch, arranged to move relative the die in a direction opposed to that of the advance movement of the first punch, and f) retracting the first punch axially, and relieving the biasing tension from the at least one die plate thereby regaining its initial form and simultaneously expelling the compacted material.

Another object of the invention is to provide a device for performing the method according to the invention. According to a further aspect, the present invention provides a device for compression of rotational symmetrical powder metal bodies, comprising: a die comprising at least one die plate having a through-opening forming a substantially cylindrical compacting chamber, a first punch movable in a direction substantially parallel to the axis of said through-opening and between a first position exposing the top part of the through-opening and further positions wherein the first punch is positioned inside the through-opening, a second punch provided at an end of the through-opening opposite to the first punch, the at least one die plate, at least at its center portion surrounding the through-opening is elastically movable in a direction substantially coinciding with advance movement of the first punch, the at least one die plate being arranged to be subjected to a biasing force in the advance direction of the first punch, thereby obtaining an increasing biasing and a simultaneous reduction of the radial size of the opening.

DETAILED DESCRIPTION OF THE INVENTION

Figure 1:
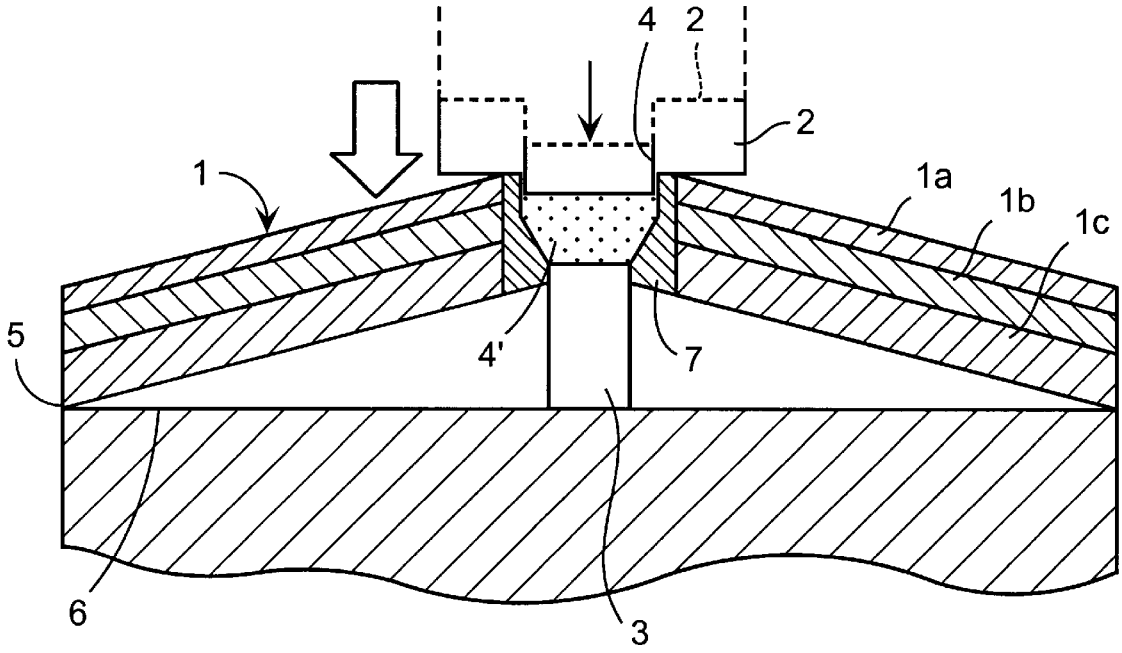
FIGS. 1–3 show schematically and in cross section three consecutive steps of a method according to the present invention performed with a device for compression of powder compacts.
Figure 2:
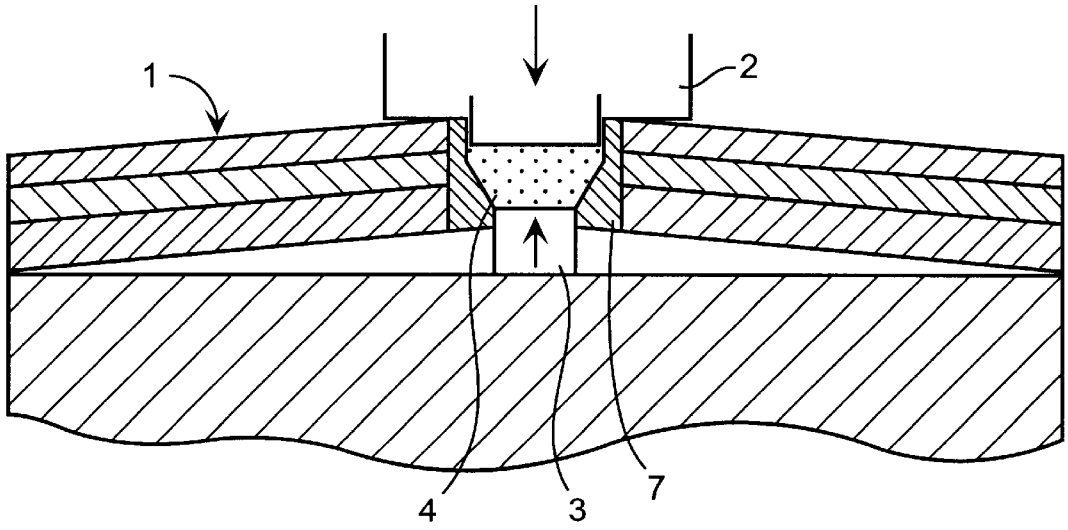
Figure 3:
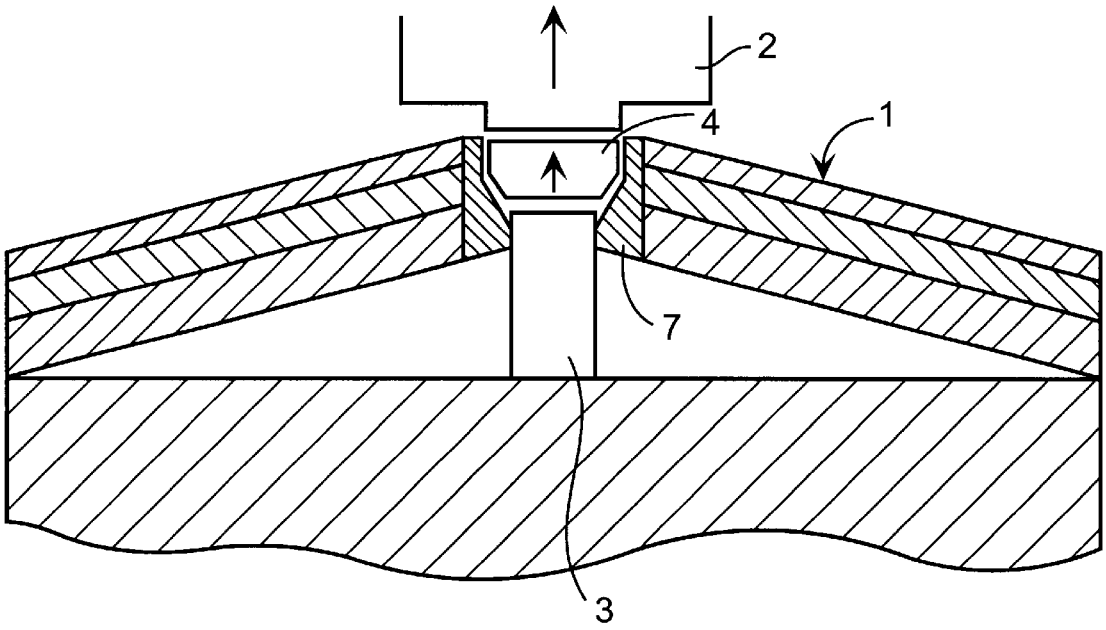

The device shown in FIGS. 1–3 comprises a die 1, formed as a die plate of certain thickness and having a centrally positioned aperture or through-opening extending entirely through the die plate, an upper punch 2, and a lower punch 3 which together with the aperture in the hollow die form a compacting chamber 4, which is arranged to be supplied with a volume of a powder material 4'. The upper punch 2 is movable in directions substantially in the longitudinal direction of the aperture in the die, whereas the lower punch 3 is aligned with the upper punch and with the aperture, the lower punch being either movable in the same directions as the upper punch or being affixed to the base.

In FIG. 1 the first or upper punch 2 is shown in phantom lines completely retracted from the through-opening 4 in the die plate 1, in which position the compacting chamber 4 can be filled with a predetermined volume of powder to be compacted by means of any appropriate filling device available. The first punch 2 is shown in continuous lines in its initial position at the beginning of the press action.

The die plate 1 has a substantially circular outer shape, and as can be seen the die plate 1 is shaped as a truncated tubular cone, having its outer rim positioned on a substantially planar base and its centrally disposed through-opening at a level spaced above the outer rim. By the fact that the die plate 1 thus has the shape of a truncated, tubular cone, the bottom side of the die plate closest to the through-opening will not contact the base when not being subjected to forces acting substantially in the direction of the cone axis. It is however also possible to use a material disk, e.g. of initially planar form, and which is given a pretension by being subjected to pressing, preferably by means of a hard metal sleeve which is pressed into the bore of the disk or of the stack of disks.

The hollow die plate 1 thereby is made in such a manner that it has a certain flexibility in the direction of movement of the upper punch. According to one embodiment of the invention, the die plate 1 comprises one or more substantially circular cup springs 1*a*, 1*b*, 1*c*, having an envelope wall extending mainly tapering from an outer rim 5 toward the centrally provided aperture or through-opening forming the compacting chamber. In the embodiment schematically shown in FIGS. 1–3 of the drawing, the die plate 1 consists of three members 1*a*, 1*b*, 1*c*, which are stacked on top of each other, and which may preferably slide against each other.

Due to its shape in the form of cup springs, the die plate 1 or stack of die plate elements 1*a*, 1*b*, 1*c*, when positioned with its outer rim 5 resting on a horizontal base 6 will have its central area positioned above said base, and a force acting from above against the center of the die plate 1 in the area of the through-opening will cause the die plate to be resiliently pressed down, whereas the die plate will resume its initial position, when such a force is relieved.

In the embodiment shown in FIGS. 1–3, the compacting chamber 4 is intended for production of rotational bodies having a generally cylindrical shape with a tapering portion. When the die plate 1 is not acted upon by a central force as mentioned above, the central through-opening in the die elements 1*a* and 1*b* has a cylindrical shape, whereas the third die plate element 1*c* has a tapering shape with the biggest diameter adjacent the through-opening in the second die plate element 1*b* and being of a size corresponding to that of the through-opening in the second die plate element 1*b*, whereas its smaller diameter end is facing away from the second die plate element 1*b*. Thus, the inner diameters of the die plate(s) form the compacting chamber.

Figure 4:
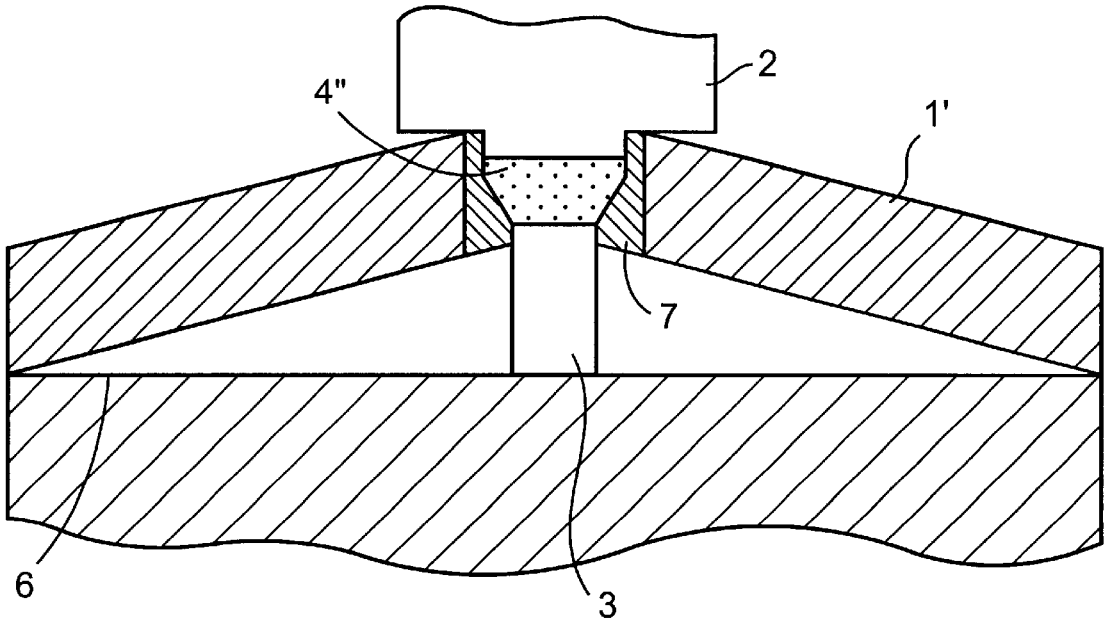
FIG. 4 is a view mainly corresponding to FIG. 2 and showing an alternative embodiment of the device according to the invention.

The die plate might of course be made in one piece, such as shown in FIG. 4 although its strength can be increased with a multi-layer design, and forming of through-openings, which are not completely cylindrical can be facilitated with such die plates.

As shown in FIG. 4, the die plate 1' can be a one-piece die plate formed in the manner of a cup spring, and having such a resiliency that the upper punch 2 will cause the die plate to deflect and be urged downwards with its center portion during, the compacting operation, thereby also causing a certain "crimping" of the diameter of the through-opening, causing a further compacting action in radial direction.

Further, as illustrated in FIGS. 1–4, the die plate(s) 1, 1*a*–1*c*, or 1' also may be equipped with a separate insert 7, e.g. from a harder material, constituting the element for the through-opening of the die plate thus forming the compacting chamber. Thus this insert 7 is provided with a through-opening being of the shape of the powder compact 4" intended to be produce therein.

The process for production of rotational symmetrical powder metal bodies comprises:

a) introducing of a predetermined volume of powder material 4', 4" to be compacted in a compacting chamber 4, provided in a hollow die 1; 1', 7, and which has substantially the cross sectional shape of the body to be produced, b) compacting the material in mainly the axial direction in the compacting chamber by means of a first punch 2, being urged axially in a forward or advance direction into said compacting chamber, c) advancing said first punch 2 further into said compacting chamber, thereby further compacting the powder material and simultaneously imparting upon the die plate 1 a biasing tension, causing the edge portion encircling the opening in the die plate 1 to move slightly under increasing tension in the direction of the advance movement of the first punch 2, thereby causing radial reduction of the size of the opening, d) also causing axial compression in a direction opposed to that caused by the said first punch 2 by means of a second punch 3, arranged to move relative the die in a direction opposed to that of the advance movement of the first punch 2, and e) retracting the first punch 2 axially, thereby causing the hollow die to be relieved from its biasing and regaining its initial form, thereby simultaneously expelling the compact thus compressed in the compacting chamber.

The method functions very well for production of powder compacts of small or moderate sizes, but for larger bodies it can be necessary to delay the advance movement of the second punch 3 for an extended time, while maintaining the force exerted by the first or upper punch 2, thereby to reach an equalizing of the pressure in the body and also for giving a possibility of producing large compacts at press having a limited power.

The relative movement of the second punch 3, can be achieved either with a movable second punch, or with a static punch, in which case the relative movement between die and said second punch is obtained due to the movement in a direction toward the second punch, which the die plate makes, following the influence thereon from the first punch 2, during the initial step of the compacting action.

While the present invention has been described by reference to the above-mentioned embodiments, certain modifications and variations will be evident to those of ordinary skill in the art. Therefore the present invention is to limited only by the scope and spirit of the appended claims.

I claim:

1. A method for producing a rotational symmetrical powder metal body comprising:

a) introducing a predetermined volume of powder material into a compacting chamber provided in a hollow die comprising at least one die plate having a central opening, which has substantially the cross sectional shape of the body to be produced, b) compacting the material in mainly an axial direction in the compacting chamber with a first punch, by urging said first punch axially into said compacting chamber, c) advancing said first punch further into said compacting chamber, thereby further compacting the powder material, d) imparting upon the at least one die plate a biasing tension, causing an edge portion encircling the opening in the at least one die plate to move slightly under increasing tension in the direction of the advance movement of the first punch, thereby causing radial reduction of the size of the opening, e) causing axial compression also in a direction opposed to that caused by the said first punch by means of a second punch, arranged to move relative the die in a direction opposed to that of the advance movement of the first punch, and f) retracting the first punch axially, and relieving the biasing tension from the at least one die plate thereby regaining its initial form and simultaneously expelling the compacted material.

2. The method as claimed in claim 1, wherein the relative movement between the die and the second punch is obtained by means of the motion towards the second punch imparted upon a central area of the die by the advance motion of the first punch, the second punch is movable or stationary in relation to a base.

3. The method as claimed in claim 1, wherein the movement of the first punch when advancing further into the compacting chamber, according to step c) is used for imparting upon the at least one die plate the biasing tension, according to step d).

4. The method as claimed in claim 1, wherein the at least one die plate comprises a cup spring.

5. A device for compression of rotational symmetrical powder metal bodies, comprising:

a die comprising at least one die plate having a through-opening forming a substantially cylindrical compacting chamber, a first punch movable in a direction substantially parallel to the axis of said through-opening and between a first position exposing the top part of the through-opening and further positions wherein the first punch is positioned inside the through-opening, a second punch provided at an end of the through-opening opposite to the first punch, the at least one die plate, at least at its center portion surrounding the through-opening is elastically movable in a direction substantially coinciding with advance movement of the first punch, the at least one die plate being arranged to be subjected to a biasing force in the advance direction of the first punch, thereby obtaining an increasing biasing and a simultaneous reduction of the radial size of the opening.

6. The device as claimed in claim 5, wherein the at least one die plate is constituted as a disc, which is initially substantially planar and having a central through-opening, in which through-opening there is provided a sleeve formed insert of hard metal material, introduced by pressing, resulting in an elastic deformation of the die plate to the form of a truncated, tubular cone.

7. The device as claimed in claim 5, wherein the at least one die plate is constituted by a tubular element having a shape of a truncated, tubular cone.

8. The device as claimed in claim 6, wherein the at least one die plate element has a rim supported on a substantially planar and horizontal base, whereby contact between the rim and base is on a plane a certain distance below the central portion of the at least one die plate.

9. The device as claimed in claim 5, wherein the at least one die plate is in the form of a tubular truncated cone having the shape and action of a cup spring.

10. The device as claimed in claim 9, further comprising a plurality of plates each having the shape of a tubular truncated cone stacked on top of each other.

* * * * *